US007075433B2

(12) United States Patent
Singer

(10) Patent No.: US 7,075,433 B2
(45) Date of Patent: Jul. 11, 2006

(54) BLUETOOTH THEFT CONTROL

(75) Inventor: Wolfgang Singer, Vienna (AT)

(73) Assignee: International Business Machines Corporation, Armonk, NY (US)

( * ) Notice: Subject to any disclaimer, the term of this patent is extended or adjusted under 35 U.S.C. 154(b) by 16 days.

(21) Appl. No.: 10/351,059

(22) Filed: Jan. 24, 2003

(65) Prior Publication Data

US 2004/0032325 A1 Feb. 19, 2004

(30) Foreign Application Priority Data

Jan. 26, 2002 (EP) ..... 02001821

(51) Int. Cl.
*G08B 13/18* (2006.01)

(52) U.S. Cl. ..... 340/568.1; 340/539.13; 340/539.15; 340/539.23; 340/573.1

(58) Field of Classification Search ..... 340/568.1, 340/539.1, 539.13, 539.15, 539.23, 539.11, 340/539.21, 573.1
See application file for complete search history.

(56) References Cited

U.S. PATENT DOCUMENTS 5,748,084 A 5/1998 Isikoff ..... 340/568
5,757,271 A * 5/1998 Andrews ..... 340/568.1
6,011,471 A * 1/2000 Huang ..... 340/568.1
6,137,409 A * 10/2000 Stephens ..... 340/568.1
6,265,974 B1 * 7/2001 D'Angelo et al. ..... 340/568.1
6,351,209 B1 * 2/2002 Snyder ..... 340/426.11
6,472,986 B1 * 10/2002 Sorriaux ..... 340/571
6,570,610 B1 * 5/2003 Kipust ..... 348/156

FOREIGN PATENT DOCUMENTS

GB 2389216 A * 3/2003

* cited by examiner

*Primary Examiner*—Daniel Wu
*Assistant Examiner*—Samuel J Walk
(74) *Attorney, Agent, or Firm*—Kunzler & Associates

(57) ABSTRACT

The present invention relates to computerized theft and displacement control and observation, dedicated to objects which represent a certain value or importance for its owner and shall thus be observed. In particular, it relates to a wireless, particular Bluetooth-based method and system. A tight, customizable Bluetooth communication involving a positive feedback control signal from the Guardian to the observed device is established (210,220,230) reflecting the usual case. This status is left when the observed device leaves the reception area of the Guardian as the positive feedback signal misses (220,240). Then the observed device sends out (260) standardized "I am stolen" signals which can be received and evaluated fully automatically at multiple locations by respective Theft Monitors. Thus, respective measures can be undertaken to seize the device, e.g., by issuing a selective quiet alarm.

21 Claims, 3 Drawing Sheets

BLUETOOTH THEFT CONTROL

BACKGROUND OF THE INVENTION

1. Field of the Invention

The present invention relates to computerized control and observation of objects that may be subject to theft and misplacement. In particular, it relates to wireless method and system in this regard that is dedicated to objects which represent a certain value or importance for its owner and shall thus be observed.

2. Description of Related Art

In today's social and business environments many valuable things are displaced or stolen. Among them computer equipment, medical equipment, technical equipment, pieces of art, luxury cars, etc. Those things are found to be of large size and sometimes of small size as well, e.g., in case of PDA's, notebooks, or any other portable article, of maybe increased personal value only. Generally, it is useful to be able to pinpoint the current location of these devices, i.e., an observation of them is desired and useful.

Those objects or devices are further referred to herein as 'observed devices'.

A theft/misplacement detection method for tracking the current location of an 'observed device', in which for the case the observed device is stolen or displaced, a preprogrammed sequence of actions is triggered by wireless communication control, is disclosed in U.S. Pat. No. 5,748,084.

This prior art document addresses a method and system for locating, communicating and managing small electronic devices, especially laptop-computers, but also other microprocessor-containing devices or instruments. A tamper-proof beacon unit includes a transponder or transceiver within the laptop-computer. Under normal circumstances the beacon implements a standard communication function for the general communications needs of the device such as e-mail, voice, data or other communication tasks. When theft of the computer occurs, however, the beacon can be activated with a security control program in order to secure crucial data in the computer's storage, to enable or disable functions of the computer, and to either transmit or destroy or hide sensitive data. The transmission signal of the, beacon is preferably also trackable to locate and recover the stolen computer. The security control program is intended to be invoked by the owner of the stolen device as soon as he is aware that the device is stolen. In this situation, the owner calls a phone number associated with the stolen device. The stolen device is ready to receive the call even if it is switched off. The owner's call acts as an activation signal in order to run the security control program. Thus, said program can execute whatever necessary in order to satisfy the individual needs of the owner, when they are reflected in the security control program.

According to this prior art approach a preferably two-way-RF-link, such as a cellular phone link is used for communication with the stolen device. A security mechanism can thus be remote-controlled by the owner of the device in order to prevent the thief from using the device. This is of certain value, for example for those devices of which the business value is either the data stored within the device or the technical functionality of the device itself. A high-end notebook computer is an example for the latter case. A luxury car is an example of a device of high economic value, but without data having an increased business value.

This prior art approach has some specific disadvantages:

First, the efficiency is limited because the activation of the security control program is may be far too late, as it is activated by a user phone call which comes in at the earliest instance shortly after the owner has detected that the device has been stolen. Thus, it can be too late for undertaking any adequate measures, as for example, to close a building in which the device was stolen in order to control the people leaving the building.

A second disadvantage is that this prior art approach can hardly be applied in order to observe and thus protect devices which do not contain a microprocessor and a transceiver unit as these technical units are used as technical components within the protection concept. In case of two-way-RF-link, i.e. cellular phone-link, such protection logic is quite expensive and complicated to hide within the device. This is particularly true for non-technical objects, like precious paintings, for example only.

Third, if the device is once stolen there is no possibility provided for helping the device to be found again except to prior art cellular locating technology on triangulation base. This possibility is of limited value only because big efforts must be undertaken in order to search for the stolen article.

BRIEF SUMMARY OF THE INVENTION

It is thus an objective of the present invention to provide for a method and system with generally improved theft control, which is more flexible to be used and more efficient to find the stolen object again, and which may have a shorter reaction time to issue an alarm signal, etc., i.e., immediately after the object was stolen.

This objective of the invention is achieved by the features stated in enclosed independent claims in combination with each other or alone. Further advantageous arrangements and embodiments of the invention are set forth in the respective dependent claims. Reference should now be made to the appended claims.

According to the invention, a tight, customizable, preferably Bluetooth communication involving a positive feedback control signal from the Guardian to the observed device is established reflecting the usual case. This usual—in the sense of normal, or regular—status is left when the observed device leaves the RF-reception area of the Guardian as the positive feedback signal misses. Then the observed device sends out standardized "stolen" signals which can be received and evaluated fully automatically at multiple locations by respective Theft Monitors provided by the invention for this purpose. Thus, respective measures can be taken to seize the device, e.g., by issuing a selective quiet alarm.

According to the present invention, a detection method useable for theft and displacements of articles is disclosed which is performed preferably between the above mentioned three types of devices, i.e. observed, Guardian and Theft Monitor devices. In variation of this the of a Theft Monitor device, however, may also be included into the Guardian device type. The present invention thus uses a cooperation between the above mentioned three types of devices, which are generally found distributed and separated from each other. They communicate within a wireless observation communication dialogue having a desired limited spatial reception range, as for example some meters or some tens of meters between the observed device and the Guardian device. But it should be noted that this quantity of reception range is scalable and does basically not limit the scope of the claims. The above mentioned signals distinguish between a theft/misplacement status and a regular status of a respective observed device. The distributed character of the present invention thus involves the claim structure which splits up accordingly.

In a synthesis view combining the activities of the separate inventional methods, the characterizing steps are as follows:

a) repeatedly sending 'OK' signals from within the observed device according to a predetermined repetition scheme,
b) continuously monitoring from within at least one separate Guardian device associated with said observed device for 'OK' signals issued by said observed device,
c) in case of 'OK signal' receipt by the Guardian device sending an 'OK-acknowledgement' signal for receipt by the observed device, otherwise this signal is not sent;
d) receiving said 'OK-acknowledgement' signal within said observed device,
e) in case of an alarm event, for example when said 'OK-acknowledgement' signal is not received by said observed device within a predetermined, adjustable acknowledgement time span, of for example 1 minute after receipt of the preceding OK acknowledgement signal, or alternatively, when receiving an explicit switch command signal, repeatedly sending 'NOT OK', i.e., "I am stolen" (s. FIG. 2) signals from within the observed device according to a predetermined repetition scheme,
f) protecting the observed device so as to maintain transmission capability to send out 'NOT OK' signals, in order to allow for detecting the observed device in case a theft has occurred,
g) continuously monitoring from within at least one separate Monitor device for 'NOT OK' signals issued by said observed device,
h) triggering predetermined actions when a Monitor device has received a 'NOT OK' signal.

Thus, as a person skilled in the art may appreciate, the inventional approach distributes activities comprised within its concept onto different devices: first, the observed or protected device itself, second, at least one guardian device and third, one or more theft monitoring devices.

Basically, the device under observation sends out "OK" signals via a license-free RF-frequency-range, as for example provided by the Bluetooth concept or by infrared communication technology. An "OK" signal means that the device is neither stolen nor displaced, nor anything else being wrong with it. Those signals are repeatedly transmitted and are usually received by one or more of the above said, so-called guardian devices, which may be represented, for example by a personal computer having a Bluetooth interface and being located near enough to the observed device in order to receive the Bluetooth signals from the device under observation. The guardian acknowledges an "OK" signal by transmitting a similar "OK" signal back to the observed device, which receives said signal and processes it in order to continue with sending the "OK" signal, i.e., "I am here" signal.

According to a basic, preferred, aspect of the present invention the absence of "OK" acknowledgement signal triggers the observed device to send out a "NOT OK" signal which means "I am stolen", or has an extendable meaning dedicated for "something is wrong", depending on Timer intervals specified by the owner. This signal can now be received by the inventional third type of device, i.e., the monitor device, and, when the signal is received any predetermined action can be triggered in order to for example close the doors of a building from which the device could be stolen or anything other action suited according to any respective situation. Advantageously, the reaction time needed for the device to send out the "NOT OK" signal can be set according to a specific situation and the specific value of the observed device. Thus, a very precious device can be accompanied by a very short reaction time. Thus, in particular when combined with a plurality of theft monitor devices the precious device can be efficiently prevented from being taken out of the building in which it was just stolen.

Advantageously, the Bluetooth wireless network can be used for observing many objects which are per se not computer-comprising objects, such as for example paintings, precious books, or anything without built-in processor, because the Bluetooth technology can be implemented in a very small area, such that it is possible to hide the transceiver unit including any required chip logic at any adapted location attached to or hidden within the interior of the object observed.

Further, it should be understood that the theft monitor device can also be implemented into the guardian device, as well, whenever this measure appears advantageous. The inventional device observation circuit which comprises the RF-transceiver unit, chip logic for the required processing steps and, advantageously an autonomous power supply can be attached or incorporated easily into many objects desired to be observed at quite low cost. The guardian device may comprise a data base or a file system having a table like map between the Bluetooth ID of the devices under observation and management by the guardian and, if required further information, as well. Such information may, for example be the address of the owner of the object, his telephone number, a telephone number to be automatically called for the purposes of issuing an alarm, and any other automated or half-automated procedure in order to catch the thief of the device.

The inventional theft monitor device can be implemented as low-cost standalone devices for implementation in corporate buildings, for example within the entrance/exit/reception hall, at garage exits, or even at gas stations, police stations, airport security entrances, country borders, etc, wherever it seems useful.

An advantage of some aspect of the present invention is that by virtue of continuously sending out the "NOT OK" signal ("I am stolen signals") a continuous, passive search activity is established that works independently of police activity, or the like. Thus, the probability is quite large, that a stolen device sends out a "NOT OK" signal which is received by any of the theft monitor devices distributed at a plurality of locations in a country, or even worldwide. Thus, even after several months, or even years a stolen device can be detected accidentally and the measures can be taken, as for example, the police station in the vicinity of the theft monitor can be alarmed or any other suited measure can be undertaken.

The actions to be triggered by a theft monitor device after having received a 'NOT OK' signal may comprise at least one or more of the following:

a) sending at least location information of the theft monitor and the respective device ID to a server system for alarming purposes,
b) for detecting the thief, taking a snapshot photograph record of the environment of the theft monitor, when the received 'NOT OK' signal strength is about its maximum intensity, c) for detecting the thief, taking a video record of the environment of the theft monitor, when the received 'NOT OK' signal strength is about its maximum intensity.

Of course, the action to be triggered can be dependent of the value rating of the observed device. For example a stolen device having a value of more than 10,000 USD may automatically trigger an alarm to the next police station.

Further, the theft monitor devices can be integrated into a large variety of technical units, as for example cash terminals, or others, even in devices of street lightings. Thus, a circuit can be implemented which makes a street lighting flicker when it detects the "I am stolen" signal. Thus, the person walking next to the street lighting device is maybe a thief or carries some stolen device with herself.

Further, when the Guardian device has an interface to a PC or is implemented within a PC program and comprises logic means for storing initialization information comprising details of the definition of an alarm event and an ID of a respective observed device, and means for transmitting said initialization information to an observed device for activating and deactivating a status of observation, the beginning and the end of the observation can be comfortably realized by aid of a standard PC interface. Of course, this can be done comfortably for more than one observed device from a single Guardian device. In this case, a respective setting table can be managed which specifies the plurality of device IDs and individual setting data of a respective individual alarm definition. Further, a secret code may be stored for each device for resetting a stolen device sending a 'NOT OK' signal, in order to send 'OK' signals again, after it has been successfully recovered.

Thus, this enables for a comfortable administration and protection, i.e. observation, of devices which have no interface component, like a keyboard or a monitor. In case of Bluetooth, a kind of Bluetooth "bootstrap protocol" can initialize the devices and bring them into any desired observation status, as, for example "observation active" or "observation inactive", or any other status if desired.

BRIEF DESCRIPTION OF THE DRAWINGS

The present invention is illustrated by way of example and is not limited by the shape of the figures of the drawings in which.

DETAILED DESCRIPTION OF THE INVENTION

With general reference to the figures, an illustrative preferred embodiment is described in more detail with respect to the inventive features and an exemplary control flow implementation thereof, distributed over three types of devices describes above. Bluetooth technology is used for wireless communication. Other communication concepts can be basically applied when particular different advantages shall be achieved or requirements must be satisfied. The Bluetooth technology, however, enables wireless communication within a distance of 10 or 100 meters. It is estimated that it will be implemented in approximately 60 million devices by the year of 2003 and in more than 600 million devices by the year of 2005. Typical Bluetooth devices are now desktop PCs, notebooks, Personal Digital Assistants (PDAs), mobile phones, cars, audio/video equipment, remote controls, etc. All Bluetooth devices have 'burnt in' unique 48 bit addresses. Thus, according to the present invention Bluetooth is very well positioned to make an efficient contribution in the fight against theft.

Figure 1:
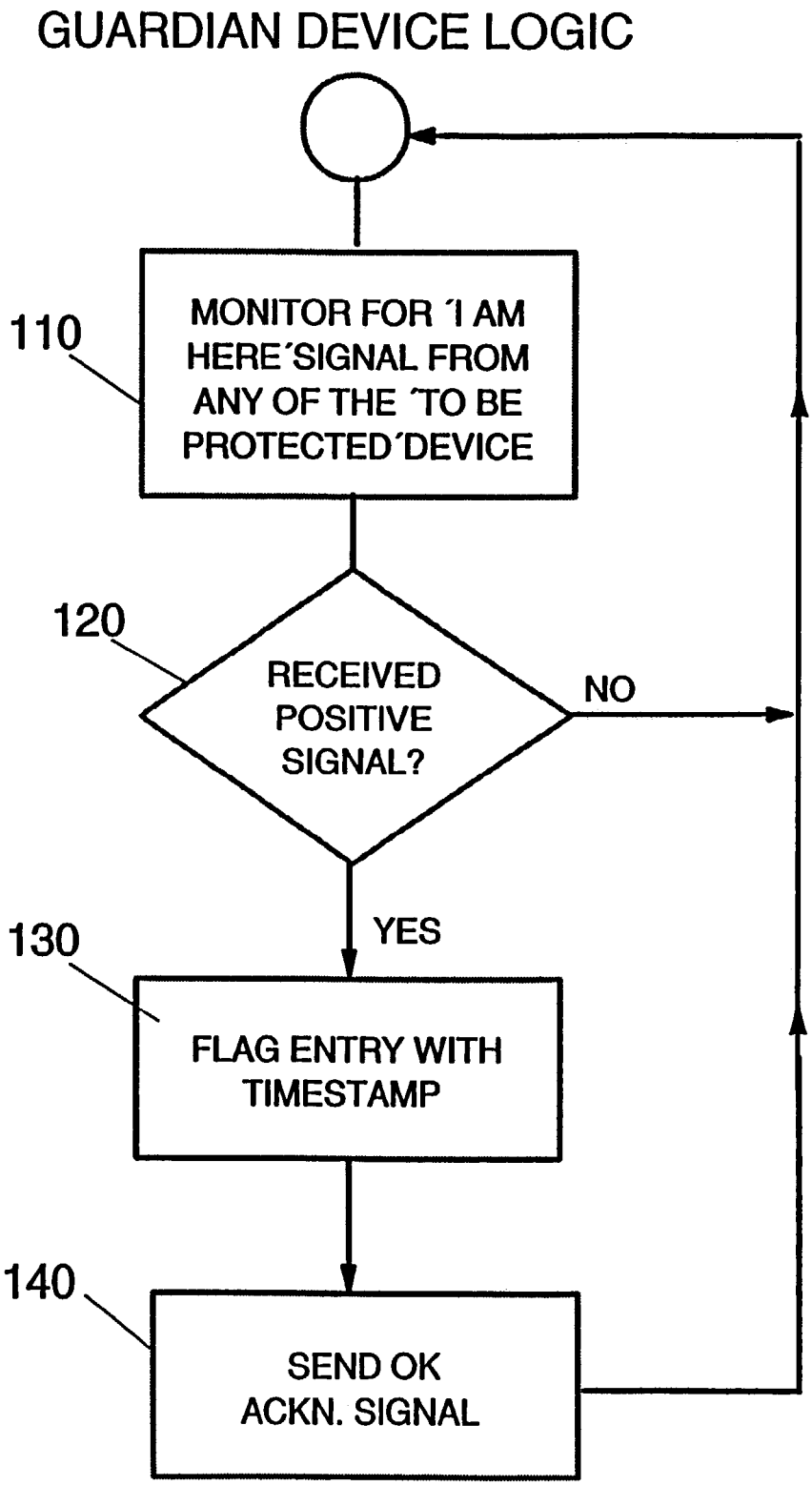
FIG. 1 is a schematic control flow diagram illustrating the functionality of the guardian device according to an inventive embodiment.

With special reference now to FIG. 1, a Bluetooth enabled device called the Guardian, which is typically a desktop PC in a stable position, can be contacted by other Bluetooth devices that are observed against according to the invention. The observed device sends a polling signal "OK" signal at regular intervals, which are in turn user defined within an initialization data set entered into the Guardian (Timer1 e.g. 1 minute, 1 hour, 1 month), to one or more Guardian devices with the meaning "I am (still) here." The Guardian monitors that, step 110, and in case a "positive signal is received, step 120, it flags an entry of the observed device within an observation devices management table with a current time stamp, step 130. Then the Guardian sends back an "OK acknowledgment" signal to the observed device, step 140.

Figure 2:
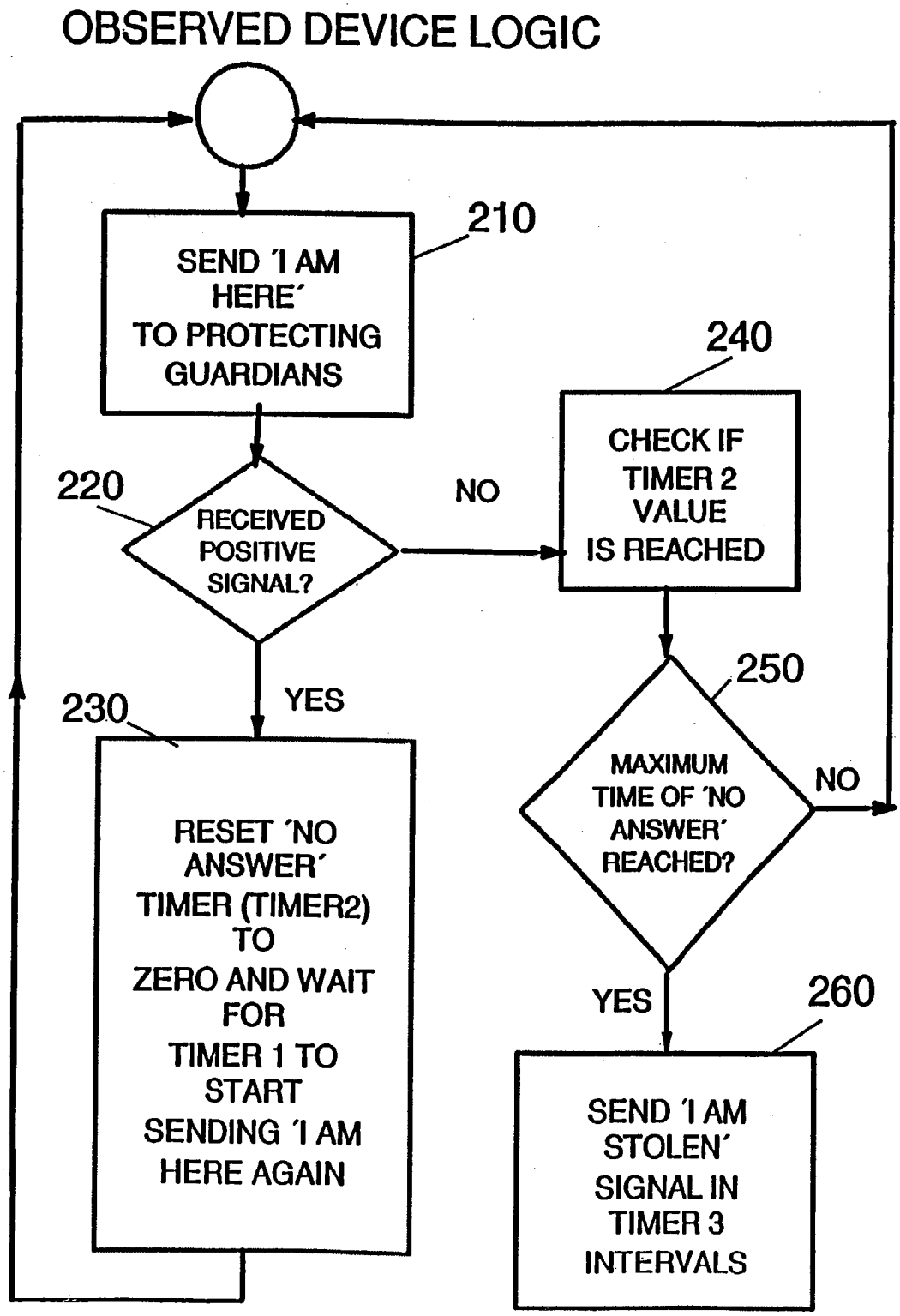
FIG. 2 is a diagram according to FIG. 1 illustrating the functionality of an observed device.

In FIG. 2, the above mentioned "OK" ("I am here") sending step 210 was already referred to at the description of FIG. 1, step 110. The transceiver unit of the observed device now monitors for the presence of OK acknowledgement signals issued from the Guardian in step 140 (see shortly above). When the observed device is removed outside the observation area of the Guardian for some time, the OK acknowledgement signal will not be received at the observed device anymore, see the No branch of decision 220. Additionally, an associated Timer2 is again user defined, for example, to 10 seconds and defines a maximum time after completion of which, see the Yes-branch of decision 250, the observed device sends a signal "I am displaced/stolen" at said Timer3 intervals, step 260. In the No-branch of decision 250 the maximum Timer3 time was not reached, i.e., the Guardian is still within the reception region of the observed device.

In the Yes branch of decision 220, when the "OK acknowledgement" of the Guardian is received by the protected device, the timer2 is reset to zero. Then the observed device waits for Timer1 to trigger the sending of the "OK" signal again to the Guardian. Then it is branched back to step 210 for doing that.

In order to find displaced/stolen equipment the above mentioned inventional Theft Monitor devices are listening to "NOT OK," i.e., "I am displaced/stolen" signals in their specific Bluetooth range (up to 100 meters), step 310. For obtaining a decision 320 it is checked if an "NOT OK" signal was received. This signal should be implemented in a standard form and be accompanied with a device ID, i.e., the corresponding Bluetooth ID, advantageously. The theft monitor logic should be implemented in a very universal form in order to receive signals with whatever Bluetooth ID and to make sure that the ID can be read out from the signal in order to find out more information on the stolen device. Such information can be retrieved from the observed device itself containing for example the name of the owner, a phone number to contact, an e-mail address to contact or whatever information seems appropriate. Additionally, for quite expansive devices such as luxury cars, a link could be made into a dedicated insurance or police car database. Then, in the Yes branch of decision 320 a "NOT OK" signal saying "I am stolen" may be received by an interested party.

Thus, the device ID is stored and a set of predetermined actions are undertaken in order to catch the device, alarm the police or do anything suited, step 330. The measures should be adequate to the value of the stolen device. Otherwise, see the No branch of decision 320, the logic branches back and continues monitoring in step 310.

Many modifications can be implemented without departing from the actual scope of the claims. Exemplary modifications are given next blow.

Instead of Bluetooth, any other wireless communications technology can be applied assumed it satisfies the legal requirements. Preferred, however, is a "silent" and automated, wireless communication which performs in the background without major participation of humans. By that, a theft control can be established which works in a decentralized manner hidden to most people.

The Theft Monitors can be implemented at PCs having a Bluetooth interface. They can typically be installed multiply and redundantly in the entrance hall of corporate buildings, and at each exit thereof, at garage exits, gas stations, police stations, airport security entrances, country borders, etc. Mobile Theft Monitors implemented in Palm Pilots can also be used to spot stolen equipment by just walking through the hallways of corporate or public buildings. The Bluetooth inherent function of controlling the sending power in dependence of the distance between the master and slave device can be used to spot the approximate location of the device sending the "I am displaced/stolen" signal, as said signal includes the sending power encoded within the transmitted signal record.

Once an observed device is initialized with the address (es) of the Guardian(s) it can only be reset to other Guardians or stopped to send the "I am displaced/stolen" signal by entering a password which is also defined at initialization time. This may be relevant, e.g. if a staff member takes an observed device—e.g. a notebook—home. Further, a guardian device can also be implemented as a portable device or built-in into a courier car, and may be constructed in a small size manner if desired. This may cover applications for courier persons in which a guardian logic is required to be worn at the body, for example by aid of a closed arm ring. This way, the observation and protection principle according to the invention can also be applied to crucial transport situations.

In the case of a notebook or other computer hardware the Bluetooth chip should be implemented on the motherboard in order to ensure that the inventional logic cannot be easily removed. To increase the probability of detecting a stolen device the Bluetooth theft protection logic can also be implemented with, for example, a reloadable battery source, which ensures that the "I am displaced/stolen" signal is also sent when the main battery is taken out.

It should be added that the above mentioned Bluetooth 'bootstrap' protocol can initialize observed devices that have no user interface, e.g. Bluetooth chips in audio/visual equipment or chips which are hidden in the frames of valuable paintings, etc. In this case the Guardian devices can transmit the initialization definitions to the Observed devices.

Applying the inventional concepts to the automotive area luxury cars can have a Bluetooth chip embedded in the motor management system, and/or hidden at secret locations of the car cabin itself. A PDA device and/or mobile phone in the owner's pocket can play the role of the Guardian device. Once the car is stolen the signal can be picked up, e.g. at toll stations, police stations, gas stations, borders, etc., as described above. Even if the mobile phone was left in the car, the "I am still here" signal can also be picked up by other Guardian stations and the Bluetooth ID can be matched against a registry of stolen devices.

The predetermined reactions of the Theft Monitors can be implemented selectively adapted to the environment of the Theft Monitor, and the nature and value of the observed device, for example, if the Theft Monitor in a gas station is picking up a signal from a stolen car in its vicinity, it can send signals via other media (as described in several other prior art documents) to police stations even without the knowledge and cooperation of the gas station staff. This helps to ensure that the staff is not engaged in activities that might put it into danger. An interruption of car functionality as it is described in several other prior art publications can also be implemented by having a Bluetooth Theft Monitor functionality implemented in the car motor management facility.

The present invention can be realized in hardware, software, or a combination of hardware and software. A tool according to the present invention can be realized in a centralized fashion in one computer system, or in a distributed fashion where different elements are spread across several interconnected computer systems. Any kind of computer system or other apparatus adapted for carrying out the methods described herein is suited. A typical combination of hardware and software can be a general purpose computer system with a computer program that, when being loaded and executed, controls the computer system such that it carries out the methods described herein.

The present invention can also be embedded in a computer program product, which comprises all the features enabling the implementation of the methods described herein, and which, when loaded in a computer system, is able to carry out these methods.

Computer program means or computer program in the present context mean any expression, in any language, code or notation, of a set of instructions intended to cause a system having an information processing capability to perform a particular function either directly or after either or both of the following:

a) conversion to another language, code or notation; or b) reproduction in a different material form.

What is claimed is:

1. A process for monitoring an observed device, the process comprising:

transmitting from the observed device a wireless normal signal indicating a normal operating status;

waiting for a determined time period to receive a wireless acknowledgement signal from a guardian device in response to the transmitted normal signal;

transmitting from the observed device a wireless alarm signal indicating an alarm status in response to not receiving an acknowledgement signal from the guardian device within the determined time period; and receiving the alarm signal at a monitor device separate and distinct from the guardian device.

2. The process of claim 1, further comprising protecting the observed device against deactivation of the transmission of the alarm signal.

3. The process of claim 1, further comprising transmitting a wireless reset signal from a guardian device to an observed device.

4. The process of claim 3, further comprising resetting the observed device to the normal operating status in response to receiving the reset signal from the guardian device.

5. The process of claim 1, further comprising transmitting the wireless acknowledgement signal from the guardian device to the observed device in response to receiving the normal signal from the observed device.

6. The process of claim 1, further comprising communicating the alarm status from the monitor device to a monitoring party.

7. The process of claim 1, further comprising triggering a predetermined action in response to the monitor device receiving the alarm signal.

8. An observed device that can be monitored, the observed device comprising:

a normal transmission module configured to transmit a wireless normal signal indicating a normal operating status;

a time delay module configured to wait for a determined time period; and an alarm transmission module configured to transmit a wireless alarm signal indicating an alarm status in response to an alarm event, the alarm signal configured for receipt by a monitor device separate and distinct from the guardian device.

9. The observed device of claim 8, wherein the time delay module is further configured to transmit an alarm event signal to the alarm transmission module if the time delay module does not receive notification of receipt of an acknowledgement signal during the determined time period.

10. The observed device of claim 8, further comprising a protection module configured to protect the alarm transmission module against deactivation of the alarm signal.

11. The observed device of claim 8, further comprising a reset module configured to reset the observed device to the normal operation status in response to receiving a reset signal.

12. A guardian device for monitoring an observed device, the guardian device comprising:

a normal transmission module configured to receive a wireless normal signal from the observed device, the normal signal indicating a normal operating status; and an acknowledgement transmission module configured to transmit a wireless acknowledgement signal in response to receiving a normal signal from the observed device, the observed device configured to transmit an alarm signal in response to not receiving the acknowledgement signal within a determined time period, the alarm signal configured for receipt by a monitor device separate and distinct from the guardian device.

13. The guardian device of claim 12, further comprising a reset transmission module configured to transmit a wireless reset signal to the observed device.

14. A process for monitoring an observed device, the process comprising:

transmitting from the observed device a wireless normal signal indicating a normal operating status;

waiting for a determined time period to receive a wireless acknowledgement signal from a guardian device in response to the transmitted normal signal;

transmitting the wireless acknowledgement signal from the guardian device to the observed device in response to receiving the normal signal from the observed device; and receiving an alarm signal at a monitor device separate and distinct from the guardian device in response to the observed device not receiving the acknowledgement signal within the determined time period, the alarm signal transmitted by the observed device.

15. A process for monitoring an observed device, the process comprising:

transmitting from the observed device a wireless normal signal indicating a normal operating status;

waiting for a determined time period to receive a wireless acknowledgement signal from a guardian device in response to the transmitted normal signal;

transmitting an alarm event signal if the observed device does not receive the acknowledgement signal during the determined time period;

transmitting from the observed device a wireless alarm signal indicating an alarm status in response to an alarm event;

communicating the alarm status to a monitoring party by way of a monitor device configured to receive the alarm signal;

transmitting a wireless reset signal from the guardian device to the observed device;

resetting the observed device to the normal operating status in response to receiving the reset signal from the guardian device; and protecting the observed device against deactivation of the transmission of the alarm signal.

16. A system for monitoring an observed device, the system comprising:

an observed device configured to transmit a wireless normal signal indicating a normal operating status;

a guardian device configured to transmit a wireless acknowledgement signal to the observed device in response to receiving the normal signal from the observed device; and the observed device further configured to send a wireless alarm signal based on non-receipt of the acknowledgement signal from the guardian device to a monitor device in response to an alarm event, the monitor device separate and distinct from the guardian device and configured to trigger a predetermined action in response to receiving the alarm signal.

17. A system for monitoring an observed device, the system comprising:

an observed device comprising:

a normal transmission module configured to transmit a wireless normal signal indicating a normal operating status;

a time delay module configured to wait for a determined time period and transmit an alarm event signal to the alarm transmission module if the time delay module does not receive notification of receipt of an acknowledgement signal during the determined time period;

an alarm transmission module configured to transmit a wireless alarm signal indicating an alarm status in response to an alarm event; a guardian device comprising:

a normal transmission module configured to receive a wireless normal signal from the observed device, the normal signal indicating a normal operating status;

an acknowledgement transmission module configured to transmit a wireless acknowledgement signal in response to receiving a normal signal from the observed device;

a monitor device comprising:

an alarm transmission module configured to receive a wireless alarm signal from the observed device, the alarm signal indicating an alarm event; and an alarm communication module configured to communicate an alarm status to a monitor party and trigger a predetermined action in response to receiving the alarm signal.

18. A computer readable storage medium comprising computer readable code configured to carry out a process for monitoring an observed device, the process comprising:

transmitting from the observed device a wireless normal signal indicating a normal operating status;

waiting for a determined time period to receive a wireless acknowledgement signal from a guardian device in response to the transmitted normal signal;

transmitting the wireless acknowledgement signal from the guardian device to the observed device in response to receiving the normal signal from the observed device;

transmitting from the observed device a wireless alarm signal indicating an alarm status in response to not receiving an acknowledgement signal from the guardian device within the determined time period;

receiving the alarm signal at one or more monitor devices each separate and distinct from the guardian device.

19. A computer readable storage medium comprising computer readable code configured to carry out a process for monitoring an observed device, the process comprising:

transmitting from the observed device a wireless normal signal indicating a normal operating status;

waiting for a determined time period to receive a wireless acknowledgement signal from a guardian device in response to the transmitted normal signal;

transmitting an alarm event signal if the observed device does not receive the acknowledgement signal during the determined time period;

transmitting from the observed device a wireless alarm signal indicating an alarm status in response to an alarm event;

communicating the alarm status to a monitoring party by way of a monitor device separate and distinct from the guardian device;

transmitting a wireless reset signal from the guardian device to the observed device;

resetting the observed device to the normal operating status in response to receiving the reset signal from the guardian device; and protecting the observed device against deactivation of the transmission of the alarm signal.

20. A system for monitoring an observed device, the system comprising:

means for transmitting from the observed device a wireless normal signal indicating a normal operating status;

means for waiting for a determined time period to receive a wireless acknowledgement signal from a guardian device in response to the transmitted normal signal;

means for transmitting the wireless acknowledgement signal from the guardian device to the observed device in response to receiving the normal signal from the observed device means for transmitting from the observed device a wireless alarm signal indicating an alarm status in response to not receiving an acknowledgement signal from the guardian device within the determined time period;

means for receiving the alarm signal at a monitor device separate and distinct from the guardian device.

21. A system for monitoring an observed device, the system comprising:

means for transmitting from the observed device a wireless normal signal indicating a normal operating status;

means for waiting for a determined time period to receive a wireless acknowledgement signal from a guardian device in response to the transmitted normal signal;

means for transmitting an alarm event signal if the observed device does not receive the acknowledgement signal during the determined time period;

means for transmitting from the observed device a wireless alarm signal indicating an alarm status in response to an alarm event;

means for communicating the alarm status to a monitoring party by way of a monitor device separate and distinct from the guardian device;

means for transmitting a wireless reset signal from the guardian device to the observed device;

means for resetting the observed device to the normal operating status in response to receiving the reset signal from the guardian device; and means for protecting the observed device against deactivation of the transmission of the alarm signal.

* * * * *

UNITED STATES PATENT AND TRADEMARK OFFICE

CERTIFICATE OF CORRECTION

PATENT NO. : 7,075,433 B2
APPLICATION NO. : 10/351059
DATED : July 11, 2006
INVENTOR(S) : Wolfgang Singer It is certified that error appears in the above-identified patent and that said Letters Patent is hereby corrected as shown below:

Figure 1,
#110, "DEVICE" should read --DEVICES--.

Figure 3:
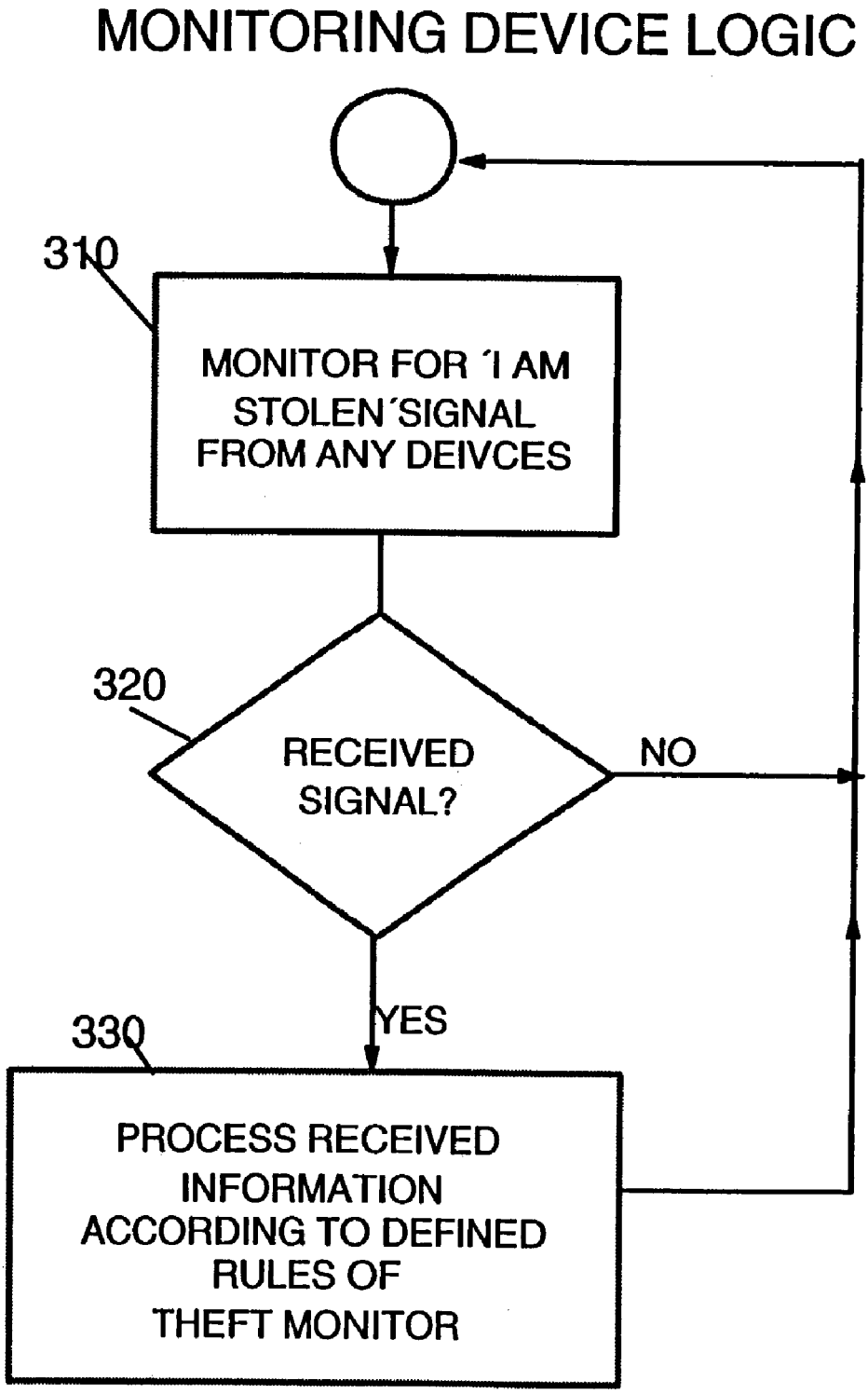
FIG. 3 is a diagram according to FIG. 1 describing the functionality of an exemplary theft monitor device.

Figure 3,
#310, "DEIVCES" should read --DEVICES--.

Column 1,
Line 53, "whatever necessary" should read --whatever is necessary--.

Column 2,
Line 3, "program is may be" should read --program may be--.

Column 2,
Line 56, "this the of a Theft Monitor" should read --this The Theft Monitor--.

Column 4,
Line 3, "stolen or anything other action" should read --stolen or any other action--.

Column 5,
Line 61, "devices describes above" should read --devices described above--.

Column 6,
Line 50, "checked if an" should read --checked if a--.

Column 7,
Line 9, "assumed" should read --assuming--.

Signed and Sealed this

Twenty-eighth Day of November, 2006

JON W. DUDAS
*Director of the United States Patent and Trademark Office*